US011853096B2

(12) United States Patent
Harris et al.

(10) Patent No.: US 11,853,096 B2
(45) Date of Patent: Dec. 26, 2023

(54) SIMPLIFIED CURVATURE COMPENSATED BANDGAP USING ONLY RATIOED COMPONENTS

(71) Applicant: Microchip Technology Incorporated, Chandler, AZ (US)

(72) Inventors: Michael Harris, Chandler, AZ (US); Daniel Meacham, Del Mar, CA (US)

(73) Assignee: Microchip Technology Incorporated, Chandler, AZ (US)

( * ) Notice: Subject to any disclaimer, the term of this patent is extended or adjusted under 35 U.S.C. 154(b) by 134 days.

(21) Appl. No.: 17/681,021

(22) Filed: Feb. 25, 2022

(65) Prior Publication Data

US 2023/0161369 A1 May 25, 2023

Related U.S. Application Data

(60) Provisional application No. 63/270,526, filed on Oct. 21, 2021.

(51) Int. Cl.
*G05F 3/22* (2006.01)
*G05F 1/46* (2006.01)
*G05F 3/30* (2006.01)

(52) U.S. Cl.
CPC ..... *G05F 3/225* (2013.01); *G05F 1/461* (2013.01); *G05F 3/30* (2013.01)

(58) Field of Classification Search
None
See application file for complete search history.

(56) References Cited

U.S. PATENT DOCUMENTS

| | | | | |
|---|---|---|---|---|
| 5,933,045 | A * | 8/1999 | Audy | G05F 3/30 327/513 |
| 8,222,955 | B2 * | 7/2012 | Duval | G05F 3/30 327/539 |
| 9,564,805 | B2 | 2/2017 | Sano et al. | |
| 10,234,889 | B2 * | 3/2019 | Arnold | G05F 3/30 |
| 10,599,176 | B1 * | 3/2020 | He | G05F 3/262 |

OTHER PUBLICATIONS

Brokaw, A.P., "A Simple Three-Terminal IC Bandgap Reference," IEEE Journal of Solid-State Circuits, vol. SC-9, pp. 388-393, Dec. 1974.

International Search Report and Written Opinion, Application No. PCT/US2022/025718, 12 pages, dated Jul. 11, 2022.

* cited by examiner

*Primary Examiner* — Jeffery S Zweizig
(74) *Attorney, Agent, or Firm* — SLAYDEN GRUBERT BEARD PLLC

(57) ABSTRACT

A curvature compensated bandgap circuit that is capable of matching best-in-class two (2) parts-per-million performance without over-temperature trimming. This improves performance metrics for precision voltage reference products without requiring individual device tuning during production thereof. A core bandgap circuit comprises a main operational amplifier having a second order bowed voltage response over temperature. A ptat circuit is coupled to the core bandgap circuit to provide a sigmoidal third order shape for the bandgap voltage.

13 Claims, 4 Drawing Sheets

SIMPLIFIED CURVATURE COMPENSATED BANDGAP USING ONLY RATIOED COMPONENTS

RELATED PATENT APPLICATION

This application claims priority to commonly owned U.S. Provisional Patent Application Ser. No. 63/270,526; filed Oct. 21, 2021; entitled "Curvature Compensated Bandgap With Minimal Process Variation," which is hereby incorporated by reference herein for all purposes.

TECHNICAL FIELD

The present disclosure relates to bandgap reference circuits, and, more particularly, to curvature compensated bandgap reference circuits and to methods and techniques for reducing process variation of these circuits.

BACKGROUND

Bandgap circuits are common in analog design and are used to provide a precision DC reference voltage with minimal variation across temperature. The bandgap circuits are used in integrated circuits to provide a stable and precise reference voltage for analog-to-digital converters (ADC), voltage comparators, voltage regulators, temperature sensors and other circuits having to deal with analog voltages or the conversion thereof to digital values.

Referring to FIG. 4, a well-known and used bandgap circuit is the "Brokaw" bandgap reference that is widely used in integrated circuits, with an output voltage 418 around 1.23 V and minimal temperature dependence. This particular circuit is one type of a bandgap voltage reference, named after Paul Brokaw, the author of its first publication. Brokaw, P., "A simple three-terminal IC bandgap reference", IEEE Journal of Solid-State Circuits, vol. 9, pp. 388-393, December 1974.

Like all temperature-independent bandgap references, the Brokaw circuit maintains an internal voltage source that has a positive temperature coefficient and another internal voltage source that has a negative temperature coefficient. By summing the two together, the first order temperature dependence can be canceled. In the Brokaw bandgap reference, the circuit provides negative feedback with an operational amplifier 402 to force a constant current through two bipolar transistors 426, 428 with different emitter areas, where transistor 426 has an emitter area (for example) eight times that of transistor 428. The transistor 426 with the larger emitter area requires a smaller base2-emitter voltage for the same current. The difference between the two base-emitter voltages has a positive temperature coefficient. The base-emitter voltage for each transistor 426, 428 has a negative temperature coefficient. The bandgap voltage output 418 is the sum of one of the base-emitter voltages with a multiple of the base-emitter voltage differences. With appropriate component choices, the two opposing temperature coefficients will substantially cancel each other and the output voltage will have significantly reduced temperature dependence. However, there is still a "bow" in voltage versus temperature where the bandgap voltages at the lowest and highest temperatures are less than the bandgap voltage at temperatures between the high and low temperatures. The resultant bandgap voltage has a bowed second order shape in relation to temperature.

Most existing solutions to obtain less bandgap voltage variation with temperature rely on modifying a traditional bandgap circuit, as shown in FIG. 4, with "curvature compensated" circuits that have an uncorrelated temperature coefficient to the basic bandgap circuit. These "curvature compensated" circuits are added to achieve less voltage variation across the range of temperatures. Curvature compensated bandgaps generally function by adding a new temperature coefficient to some element of the circuit which roughly compensates for the residual error. This may be two different types of resistors 438 or 436 having different temperature coefficients, or providing resistor 438 as a series combination of two or more different types of resistors having different temperature coefficients. The problem with these approaches is that the newly introduced element is fundamentally uncorrelated with the existing elements and needs to be factory calibrated for process variation—matching cannot be determined during circuit design. This curvature compensation circuitry adds additional circuit complexity and requires trimming at a number, typically five or more, different temperatures while requiring individual die serialization (part-to-part tuning of the circuit values). This fabrication step adds considerably to manufacturing test complexity, thereby resulting in increased manufacturing costs.

SUMMARY

Therefore, a need exists to provide a precision bandgap reference circuit that exhibits decreased sensitivity to temperature, supply voltage and process variations, does not require individual device tuning to achieve the desired voltage precision over an operating temperature range, and therefore reduces production testing costs by providing an architectural solution versus a test solution.

According to an embodiment, a precision bandgap reference circuit may comprise: a core bandgap circuit producing a voltage having a bowed second order shape by a temperature; and a proportional-to-absolute-temperature (ptat) circuit coupled to the core bandgap circuit, wherein the coupled core bandgap and ptat circuits produce a bandgap voltage having a varying sigmoidal shape by the temperature.

According to a further embodiment, the core bandgap circuit may comprise: a main operational amplifier having an output coupled to a base of a first NPN transistor, wherein the first NPN transistor has a collector coupled to a power supply positive and an emitter coupled to a bandgap voltage node; diode configured second and third NPN transistors coupled to positive and negative inputs, respectively, of the main operational amplifier and to second and third resistors, respectively, coupled to the bandgap voltage node, and the emitters thereof coupled to a power supply common; and a first adjustable resistor may be coupled between the negative input of the main operational amplifier and the third NPN transistor.

According to a further embodiment, the ptat circuit may comprise: a compensation operational amplifier having an output coupled to an emitter of the second NPN transistor and a fourth resistor; a diode configured fourth NPN transistor coupled between the fourth resistor and a negative input of the compensation operational amplifier; a positive input of the compensation operational amplifier coupled to a fifth diode connected NPN transistor; a fifth resistor coupled between the positive input of the compensation operational amplifier and the bandgap voltage node; and a sixth resistor coupled between the output of the main operational amplifier and the negative input of the compensation operational amplifier.

According to a further embodiment, the temperature may be from about minus 40 degrees Celsius to about 120 degrees Celsius. According to a further embodiment, a selected resistance value of the first adjustable resistor may be stored in a nonvolatile memory.

According to another embodiment, a precision bandgap reference circuit may comprise: a core bandgap circuit having a positive temperature coefficient; and proportional-to-absolute-temperature (ptat) circuit having a negative temperature coefficient coupled to the core bandgap circuit and is subtracted from the core bandgap circuit output voltage to produce a bandgap voltage.

According to a further embodiment, the bandgap circuit may comprise: a main operational amplifier having an output coupled to a base of a first NPN transistor, wherein the first NPN transistor has a collector coupled to a power supply positive and an emitter coupled to a bandgap voltage node; second and third PNP transistor coupled to positive and negative inputs, respectively, of the main operational amplifier and to second and third resistors, respectively, coupled to the bandgap voltage node, and the collectors thereof coupled to a power supply common; and a first adjustable resistor coupled between the negative input of the main operational amplifier and the emitter of the third PNP transistor.

According to a further embodiment, the ptat circuit may comprise: a compensation operational amplifier having an output coupled to bases of a fourth and the second PNP transistors; a sixth diode configured PNP transistor may be coupled between a positive input of the compensation operational amplifier and the power supply common; a fourth resistor coupled between a negative input of the compensation operational amplifier and an emitter of the fourth PNP transistor, wherein a collector of the fourth PNP transistor may be coupled to the power supply common; a fifth resistor coupled between the positive input of the compensation operational amplifier and the bandgap voltage node; and a sixth resistor coupled between the output of the main operational amplifier and the negative input of the compensation operational amplifier.

According to a further embodiment, the negative temperature coefficient ptat circuit may generate a correlated output that may be subtracted from the bandgap voltage to produce a sigmoidal voltage temperature curve that may have minimal voltage variation over a temperature range. According to a further embodiment, the temperature range may be from about minus 40 degrees centigrade to about 120 degrees Celsius. According to a further embodiment, the fourth resistor may linearize operation of the fourth PNP transistor.

According to a further embodiment, a unit ratio for the second and third PNP transistors may be N:M, respectively, where M may be greater than N. According to a further embodiment, M is eight (8) and N is one (1). According to a further embodiment, the third PNP transistor may comprise a parallel combination of M PNP transistors and may have a greater current density than the second PNP transistor. According to a further embodiment, a resistance value of the first adjustable resistor may be stored in a nonvolatile memory.

BRIEF DESCRIPTION OF THE DRAWINGS

A more complete understanding of the present disclosure may be acquired by referring to the following description taken in conjunction with the accompanying drawings wherein.

Figure 1:
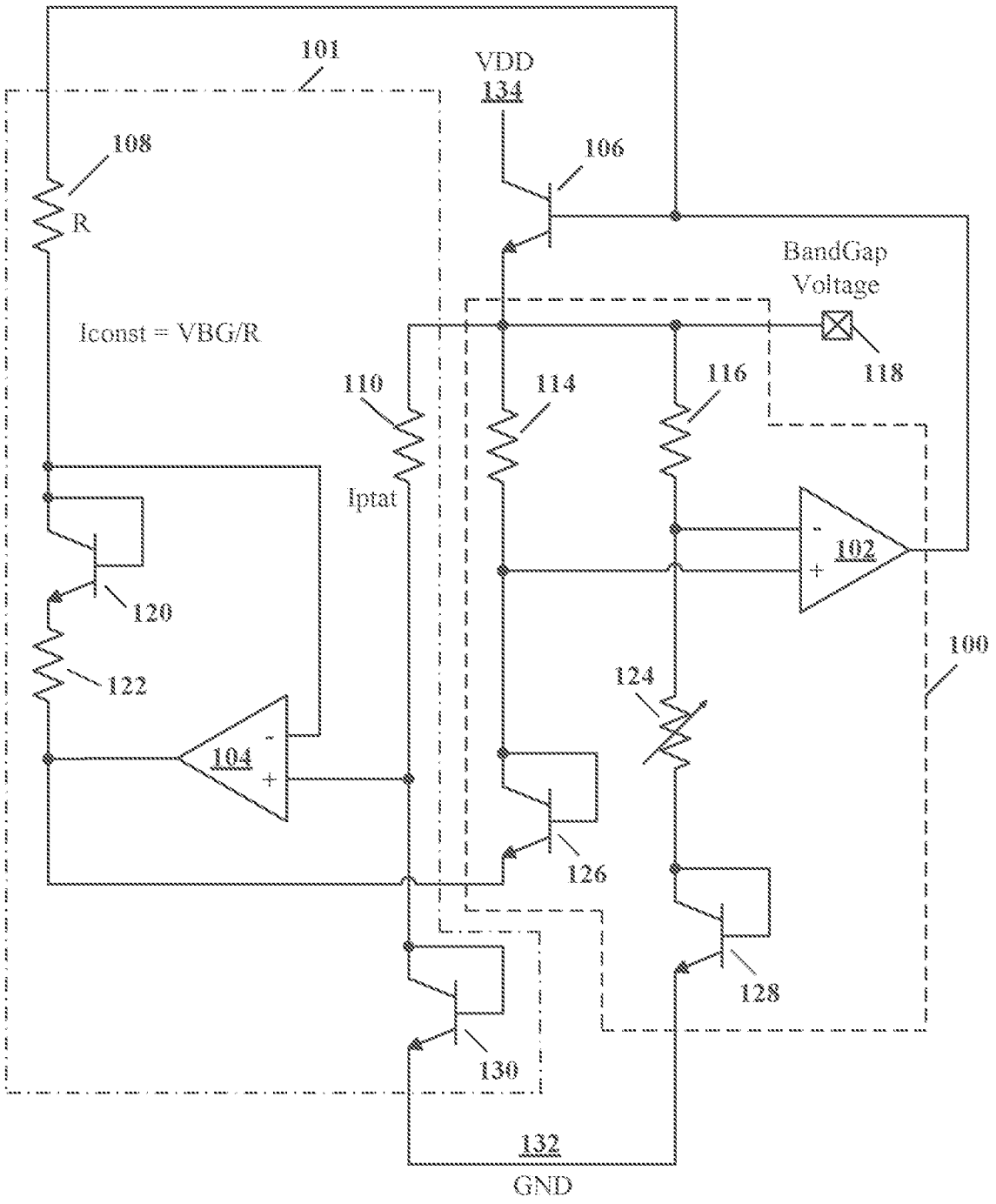
FIG. 1 illustrates a schematic diagram of a temperature compensated bandgap circuit, according to specific examples of this disclosure.

While the present disclosure is susceptible to various modifications and alternative forms, specific examples thereof have been shown in the drawings and are herein described in detail. It should be understood, however, that the description herein of specific examples is not intended to limit the disclosure to the forms disclosed herein.

DETAILED DESCRIPTION

Referring now to the drawings, the details of examples are schematically illustrated. Like elements in the drawings will be represented by like numbers, and similar elements will be represented by like numbers with a different lower-case letter suffix.

Figure 2:
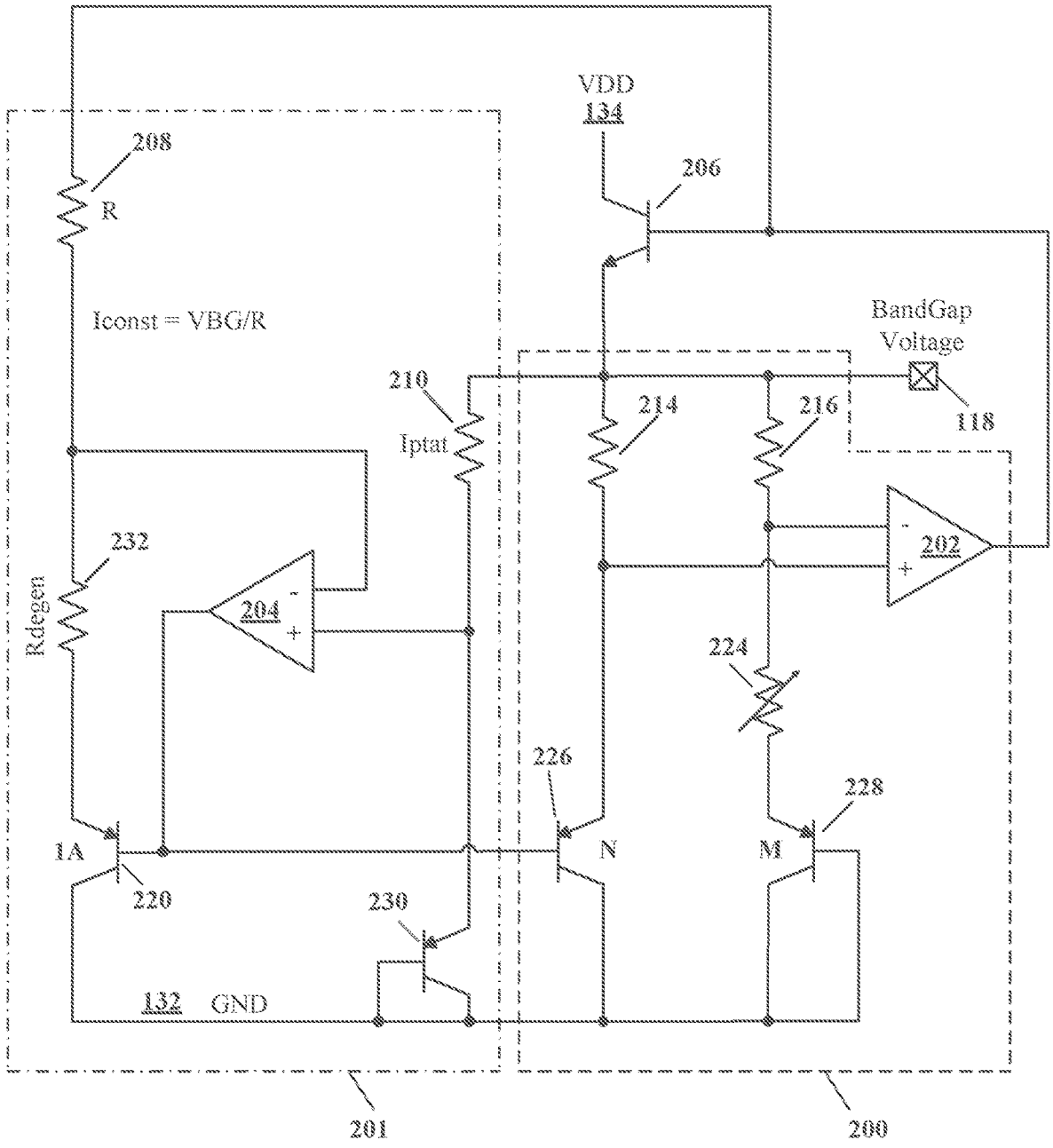
FIG. 2 illustrates a schematic diagram of another temperature compensated bandgap circuit, according to specific examples of this disclosure.

Referring to FIGS. 1 and 2, depicted are schematic diagrams of temperature compensated bandgap circuits, according to specific examples of this disclosure. A core bandgap circuit 100 comprises a main operational amplifier 102, NPN bipolar transistors 126 and 128, resistors 114 and 116 and adjustable resistor 124. Resistor 124 can be adjusted to compensate for any process modeling errors, but once a value is selected then it need not be further adjusted on a device-to-device basis or across production lots. The baseline value of resistor 124 is selected such that the Temperature Coefficient of the circuit is minimized.

The output of the main operational amplifier 102 is Vbe above the Band Gap voltage 118. A proportional-to-absolute-temperature (ptat) circuit 101 comprises a compensation operational amplifier 104, diode configured NPN transistors 120 and 130, and resistors 108, 110 and 122. The ptat circuit 101 generates a highly correlated output, very near ground, that is subtracted from the core bandgap voltage via an emitter connection of the diode configured NPN transistor 126. The core bandgap 100 and ptat 101 circuits are designed and sized such that the resulting "Bandgap Voltage" at terminal 118 conforms generally to a third order function (a sideways "S" shaped response with two inflection points within the temperature region of interest vs the bowed/"rainbow" response of a classical bandgap circuit) response in relation to temperature.

It is known (from the mathematics that a solution for the compensation bandgap components exists that should theoretically cancel the curvature and temperature coefficient (TC) when the correct ratio of resistors and bipolar transistors are in place. In practice though this is only approximate. The compensation bandgap components are selected somewhat empirically because of imperfections in the process modeling and various manufacturing non-idealities. The absolute values of the resistors are set based on current consumption which will also affect noise. Proportionally increasing or decreasing all resistor values over a reasonable range have only a small effect and can serve as an initial solution which can then be further improved once a solution is found for a given supply current.

The resulting bandgap voltage at terminal 118, denoted VBG, or vbg, has less voltage change over temperature than the core bandgap second order voltage response over temperature. All bipolar transistors are NPN devices in unit ratios (emitter area sizes) and may be, for example, silicon germanium (SiGe) construction which are low noise transistors. All resistors are the same type in unit ratios.

The top of resistor 108 is one Vbe (of transistor 106) above the bandgap voltage at terminal 118 which bandgap voltage at terminal 118 is assumed to be substantially flat over temperature. The bottom of resistor 108 is one Vbe above ground 132 because the inputs of the compensation operational amplifier 104 are forced to be the same by compensation operational amplifier 104; i.e., one Vbe of diode configured transistor 130 above ground 132. If we assume those Vbe's cancel, then resistor 108 essentially has the bandgap voltage across it. Of course, it's not exact because transistor 106 and transistor 130 have different current densities but the current through resistor 108, denoted Iconst, will be close to flat over temperature with an absolute value of bandgap voltage/resistor 108.

Referring to FIG. 2, unit ratios for transistors just means they are made from the same type of material, whereby several transistors are placed in parallel to compose one of the devices. Basically, what matters is that the transistors have a known current density difference. This could be achieved by scaling the emitter area, but the matching would not be as accurate in practice. FIG. 2 illustrates a schematic diagram of another temperature compensated bandgap circuit, according to specific examples of this disclosure. For example, the transistor 228 may be a parallel combination of M transistors, each of which are similar to transistor 226 which is only N transistor. Any ratio can be used (if the resistors were adjusted differently), however, M=eight (8) is a useful number because the eight constituent transistors, transistor 228 can physically surround the single transistor (N) of transistor 226 for good matching and as a result delta Vbe is high enough for good noise performance. For example, but without limitation, the ratio of 1 to 8 creates the known current density difference which creates the required known difference in Vbe which is very linear over a wide current range. Also, transistor 230 is composed of parallel devices to create the known delta Vbe (as with transistor 220—again one unit device) required for the compensation circuit on the left. Current densities of transistors cause different voltage drops across associated resistors which the operational amplifiers 202 and 204 use to make the circuit work.

Resistor 232 (Rdegen) may be used to linearize operation of the bipolar transistor 220, which causes it to not match the other one quite as well. It may be used to compensate for non-ideal performance in the bipolar transistors and flatten the temperature curve a little bit in certain scenarios and with certain manufacturing processes.

The bandgap circuit shown in FIG. 2 is similar in operation to the circuit of FIG. 1 but uses both NPN and PNP transistors. A core bandgap circuit 200 comprises a main operational amplifier 202, PNP bipolar transistors 226 and 228, resistors 214 and 216, and adjustable resistor 224. The adjustable resistor 224 may be used to improve performance of a design production run wherein once a resistance value for the resistor 224 is determined for a certain batch design all subsequent devices of that batch design can be set ("selected") for that resistance during production without having to individually "tune" each bandgap device for optimum performance. Since the improved performance determination has been achieved by circuit design, not by individual part adjustment during production testing.

A proportional to absolute temperature (ptat) circuit 201 comprises a compensation operational amplifier 204, PNP transistor 220, diode configured PNP transistor 230, and resistors 208 and 210. The ptat circuit 201 generates a highly correlated output, very near ground, that is subtracted from the core bandgap voltage via the PNP transistor 226. The core bandgap 200 and ptat 201 circuits are designed and sized accordingly.

The transistor ratios (classically 8 to 1) may be selected for matching and noise performance. The resistors are adjusted such that the TC and curvature is minimal at the bandgap voltage at terminal 118, i.e., the output, which TC curvature exhibits a 3rd order shape. Much of this may be done empirically in simulation. The $3^{rd}$ order shape in relation to temperature is just the residual curvature that results from summing the small curvature gain difference in the core bandgap circuit 200 and the ptat circuit 201. It can be made very small but never eliminated completely, such that the resulting "Bandgap Voltage" at terminal 118 conforms generally to a 3rd order shape whereas the core bandgap circuit would have a bowed 2nd order shape in relation to temperature. The resulting bandgap voltage at terminal 118 has less voltage change over temperature than the core bandgap 2nd order voltage response over temperature of the prior art. All bipolar transistors are in unit ratios and may be, for example, BCD (Bipolar-CMOS-DMOS) transistors such as, but not limited to, 0.18 μm. Any type of bipolar transistor can be used, however a good quality device with high beta will provide the best accuracy. Many CMOS processes do not have such devices or any bipolar devices at all beyond low beta vertical PNP bipolar transistors.

The compensation operational amplifier 204 drives its output as required to make its inputs equal, so the base of transistor 220 is driven as required to keep the current through resistor 208 and transistor 220 (neglecting base current) constant over temperature. The base of transistor 226 is also driven by the compensation operational amplifier 204. However, the result of the feedback loop of main operational amplifier 202 sets the currents through the two legs of the core bandgap circuit 200 to be PTAT, there is a very small temperature dependent signal on the inputs of the main operational amplifier 202 which creates an opposite bow (smile) at the bandgap output. The superposition of these is what flattens the bandgap.

Temperature range of the bandgap devices disclosed herein may be from about minus 40 degrees Celsius to about 120 degrees Celsius.

Figure 3:
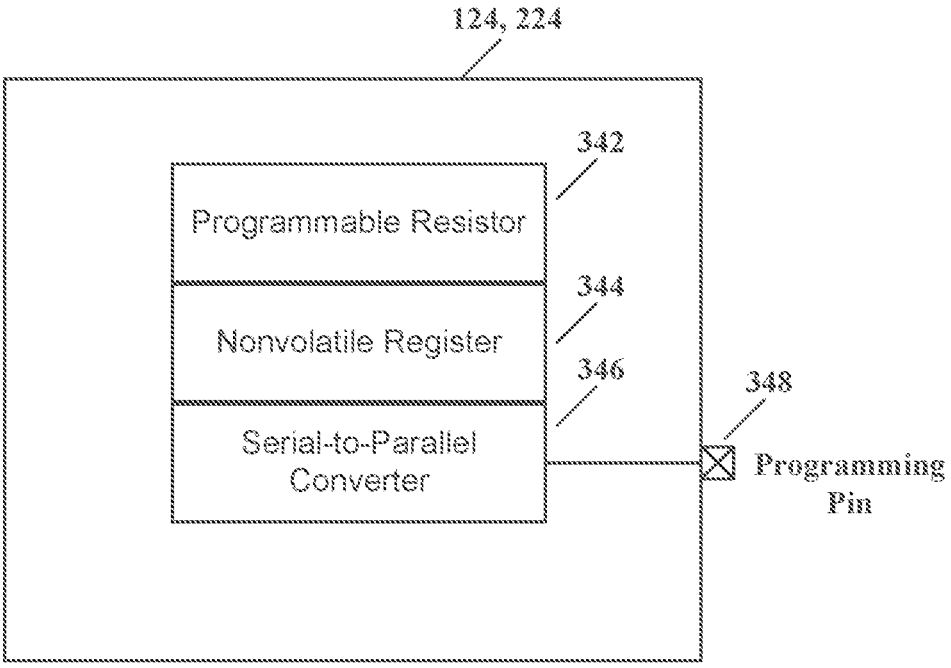
FIG. 3 illustrates a schematic block diagram of a programmable resistor function in an integrated circuit for temperature compensation adjustment of the bandgap circuits shown in FIGS. 1 and 2.
Figure 4:
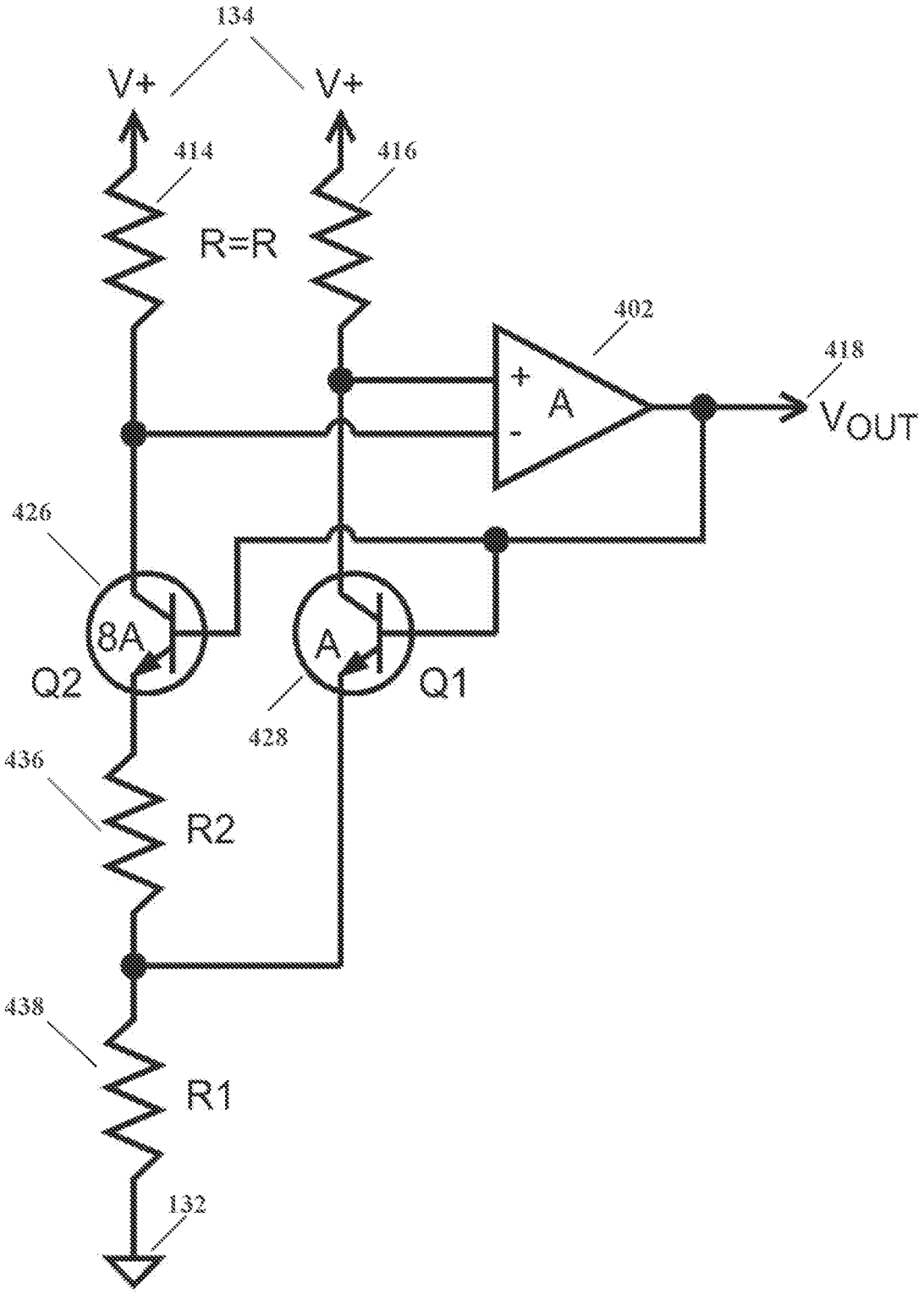
FIGURE 4 (Prior Art)
FIG. 4 illustrates a schematic diagram of a Brokaw bandgap voltage reference circuit.

Referring to FIG. 3, depicted is a schematic block diagram of a programmable resistor function in an integrated circuit for temperature compensation adjustment of the bandgap circuits shown in FIGS. 1 and 2. The adjustable resistor 124, 224 shown in FIGS. 1 and 2 may comprise a programmable resistor 342 made from a plurality of selectable resistance elements (not shown) that may be coupled together and selected by outputs from a nonvolatile register 344. A serial-to-parallel converter 346 may be used to control the nonvolatile register (memory) 344 with resistance element selection information supplied from a serial programming pin 348. Since the register 344 retains information programmed therein, it can be programmed once and retain the programmed information for the useful operating life of the bandgap circuits of FIGS. 1 and 2.

Theory of Operation for the Circuit of FIG. 1:

The voltage at the inputs of the main operational amplifier 102, in steady state denoted vx, looking from the top can be determined as:

$$vx=vbg-I114*R114 \text{ and:}$$

$$vx=vbg-I116*R116$$

Combining these equations gives equation 1:

$$I114 = I116 * \frac{R116}{R114} \quad \text{Eq. (1)}$$

The voltage at the inputs of the main operational amplifier 102, in steady state, looking from the bottom can be calculated as:

$$vx = I124 * R116 + vbe\left(\frac{I116}{A128}, T\right) \text{ and:}$$

$$vx = vy + vbe\left(\frac{I114}{A126}, T\right) - vbe\left(\frac{I108}{A120}, T\right) - R122 * I108$$

Where: vbe(d,T) is the bipolar base to emitter voltage as a function of current density (d, expressed as collector current over emitter area, and absolute temperature (T).

The vy term in the second equation represents the voltage on the inputs of the compensation operational amplifier 104 at steady state.

Combining these equations results in equation (2)

$$I116 * R124 + vbe\left(\frac{I116}{A128}, T\right) = vy + vbe\left(\frac{I114}{A126}, T\right) - vbe\left(\frac{I108}{A120}, T\right) \quad \text{Eq. (2)}$$

The voltage at the plus (+) input of the compensation operational amplifier 104 can be calculated as:

$$vy = vbe\left(\frac{I110}{A130}, T\right) \quad \text{Eq. (3)}$$

The voltage at the inputs of the compensation operational amplifier 104 looking from the top can be calculated as:

$$vy = vbg - I110 * R110 \text{ and:}$$

$$vy = -I110 * R110 + I108 * R108 - vbe\left(\frac{I110}{A130}, T\right)$$

Combining these equations results in equation 4:

$$vbg = -vbe\left(\frac{I110}{A130}, T\right) + I108 * R108 \quad \text{Eq. (4)}$$

Note that by making:

$$\frac{I110 + I114 + I116}{A106} = \frac{I110}{A130}$$

the current I108 can be made independent of temperature with:

$$I108 = \frac{vbg}{R108}$$

One equation can be eliminated by substituting equation (4) into equation (2). The result is 3 new equations:

$$I114 = I116 * \frac{R116}{R114} \quad (5)$$

$$I116 * R124 + vbe\left(\frac{I116}{A128}, T\right) = -I108 * R122 + vbe\left(\frac{I114}{A126}, T\right) + vbe\left(\frac{I110}{A130}, T\right) - vbe\left(\frac{I108}{A120}, T\right) \quad (6)$$

$$vbg = -vbe\left(\frac{I110}{A130}, T\right) + I108 * R108 \quad (7)$$

Solving equation 3 for vbe(I110/A130,T) and substituting it into equation 3, results in two equations:

$$I114 = I116 * \frac{R116}{R114} \quad \text{Eq. (8)}$$

$$I116 * R124 + vbe\left(\frac{I116}{A128}, T\right) = -vbg - I108 * R108 - I108 * R122 + vbe\left(\frac{I114}{A126}, T\right) - vbe\left(\frac{I108}{A120}, T\right) \quad \text{Eq. (9)}$$

Equation (8) can now be substituted into equation (9):

$$I116 * R124 + vbe\left(\frac{I116}{A128}, T\right) = -vbg - I108 * R122 - I108 * R108 + vbe\left(\frac{\frac{I116 * R116}{R114}}{A126}, T\right) - vbe\left(\frac{I108}{A120}, T\right)$$

$$\text{Since: } vbg = I116^{*} R116 + I116 * R124 + vbe\left(\frac{I116}{A128}, T\right)$$

Adding I116*R116 to both sides gives:

$$vbg = \left(-I108 * R122 - I108 * R108 + vbe\left(\frac{\frac{I116 * R116}{R114}}{A126}, T\right) - vbe\left(\frac{I108}{A120}, T\right)\right)/2$$

From device physics we know that the temperature characteristics of the base-to-emitter voltage can be accurately described by, $$vbe(d, T) = Vgo\left(1 - \frac{T}{T0}\right) + Vbe0\left(\frac{T}{T0}\right) + \frac{(m-1)KT}{q}\log\left(\frac{T}{T0}\right) + \frac{KT}{q}\log\left(\frac{d}{d0}\right)$$

where:

$vbe(d,T)=Vgo$~1.23V in silicon, $T0$ is a reference temperature, $Vbe0$ is $vbe$ at the reference temperature vbe(d0, T0), K is Boltzman's constant (1.38×10^23), q is the electron charge 1.602×10^−19

The bandgap voltage can now be calculated by applying the vbe(d,T) function:

$$vbg = \frac{0.5KT}{q}\left[\left(\log\frac{I116*R116}{A126*R114}\right)-\left(\log\frac{I108}{A120}\right)\right]- I108^*R122+I116^*R116+I108^*R108$$

The above will have a zero-temperature coefficient when:

$$\frac{I116*R116}{A126*R114}=\frac{I108}{A120}$$

Theory of Operation for the Circuit of FIG. 2:

The voltage at the inputs of the main operational amplifier 202, in steady state, denoted vx, looking from the top can be determined as:

$vx=vbg-I214^*R124$ and:

$vx=vbg-I214^*R124$

Combining these equations gives equation 1:

$$I214 = I216*\frac{R216}{R214} \quad \text{Eq. (10)}$$

The voltage at the inputs of the main operational amplifier 202, in steady state, looking from the bottom can be determined as:

$$vx = I216*R224+vbe\left(\frac{I216}{A228},T\right) \text{ and:}$$

$$vx = vy - I208*Rdegen - vbe\left(\frac{I214}{A226},T\right) - vbe\left(\frac{I208}{A220},T\right)$$

Where: vbe(d, T) is the bipolar base to emitter voltage as a function of current density (d, expressed as collector current over emitter area, and absolute temperature (T). The vbe(d, T) function will obviously be necessary later to calculate vbg but for simplicity its left in this form for now.

The y term in the second equation represents the voltage on the inputs of the compensation operational amplifier 204.

Combining these equations results in equation (11).

$$I216*R224+vbe\left(\frac{I216}{A228},T\right)= vy - I208*Rdegen + vbe\left(\frac{I214}{A226},T\right) - vbe\left(\frac{I208}{A220},T\right) \quad \text{Eq. (11)}$$

The voltage at the + input of the compensation operational amplifier 204 can be determined as:

$$vy = vbe\left(\frac{I210}{A230},T\right) \quad \text{Eq. (12)}$$

The voltage at the inputs of the compensation operational amplifier 204 looking from the top can be calculated as:

$vy = vbg - I210*R1210$ and:

$$vy = vbg + \frac{vbe(I210+I214+I216)}{A206} - I208*R208$$

Combining these equations results in equation 13:

$$-I210*R210 = vbe\left(\frac{I210}{A230},T\right) - I208*R208 \quad \text{Eq. (13)}$$

Note that by making:

$$\frac{I210+I214+I216}{A206}=\frac{I210}{A230}$$

The current I208 can be made independent of temperature with:

$$I208 = \frac{vbg}{R208}$$

One equation can be eliminated by substituting equation (12) into equation (13). The result is 3 new equations:

$$I214 = I216*\frac{R216}{R214} \quad \text{Eq. (14)}$$

$$I216*R224+vbe\left(\frac{I216}{A228},T\right)= -I208*Rdegen+vbe\left(\frac{I214}{A226},T\right)+vbe\left(\frac{I210}{A230},T\right)-vbe\left(\frac{I208}{A220},T\right) \quad \text{Eq. (15)}$$

$$-I210*R210 = vbe\left(\frac{I210}{A230},T\right) - I208*R208 \quad \text{Eq (16)}$$

An equation can be eliminated by solving equation 11 for vbe(I210/A230,T) and substituting it into equation 12.

This leaves only two equations:

$$I214 = I216*\frac{R216}{R214} \quad \text{Eq. (17)}$$

$$I216*R224+vbe\left(\frac{I216}{A228},T\right) = -I208*Rdegen - I210*R210+I208*R208+vbe\left(\frac{I214}{A226},T\right)-vbe\left(\frac{I208}{A220},T\right) \quad \text{Eq. (18)}$$

Since: $vbg = I216*R216+I216*R224+vbe\left(\frac{I216}{A228},T\right)$

Adding I216*R216 to both sides gives:

$$vbg = -I208*Rdegen - I210*R210+I208*R208+ vbe\left(\frac{I216*R216}{I214*A226},T\right)-vbe\left(\frac{I208}{A220},T\right)+I216*R216$$

From device physics we know that the temperature characteristics of the base to emitter voltage can be accurately described by:

$$vbe(d, T) = Vgo\left(1 - \frac{T}{T0}\right) + Vbe0\left(\frac{T}{T0}\right) + \frac{(m-1)KT}{q}\log\left(\frac{T}{T0}\right) + \frac{KT}{q}\log\left(\frac{d}{d0}\right)$$

Where:

$vbe(d,T)=Vgo\sim1.23V$ in silicon, $T0$ is a reference temperature,

Vbe0 is vbe at the reference temperature vbe(d0,T0), K is Boltzman's constant (1.38×10^23), q is the electron charge 1.602×10^−19

The bandgap voltage can now be calculated by applying the vbe(d,T) function:

$$vbg = \frac{KT}{q}\left[\left(\log\frac{I216*R216}{A226*R214}\right) - \left(\log\frac{I208}{A220}\right)\right] - I208*Rdegen + I216*R210 + I208*R208$$

The above will have a zero-temperature coefficient when:

$$\frac{I216*R216}{A226*R214} = \frac{I208}{A220}$$

The present disclosure has been described in terms of one or more examples, and it should be appreciated that many equivalents, alternatives, variations, and modifications, aside from those expressly stated, are possible and within the scope of the disclosure. While the present disclosure is susceptible to various modifications and alternative forms, specific examples thereof have been shown in the drawings and are herein described in detail. It should be understood, however, that the description herein of specific examples is not intended to limit the disclosure to the particular forms disclosed herein.

What is claimed is:

1. A precision bandgap reference circuit, comprising:

a core bandgap circuit producing a voltage having a bowed second order shape by a temperature; and a proportional-to-absolute-temperature (ptat) circuit coupled to the core bandgap circuit, wherein the coupled core bandgap and ptat circuits produce a bandgap voltage having a varying sigmoidal shape by the temperature:

wherein the core bandgap circuit comprises:

a main operational amplifier having an output coupled to a base of a first NPN transistor, wherein the first NPN transistor has a collector coupled to a power supply positive and an emitter coupled to a bandgap voltage node;

diode configured second and third NPN transistors couple to positive and negative inputs, respectively, of the main operational amplifier and to second and third resistors, respectively, coupled to the bandgap voltage node, and the emitter of the third NPN transistor is couple to a power supply common and the emitter of the second NPN transistor is coupled to the ptat circuit; and a first resistor, which first resistor is adjustable, coupled between the negative input of the main operational amplifier and the third NPN transistor.

2. The precision bandgap reference circuit according to claim 1, wherein the ptat circuit comprises:

a compensation operational amplifier having an output coupled to an emitter of the second NPN transistor and a fourth resistor;

a diode configured fourth NPN transistor coupled between the fourth resistor and a negative input of the compensation operational amplifier;

a positive input of the compensation operational amplifier coupled to a fifth diode connected NPN transistor;

a fifth resistor coupled between the positive input of the compensation operational amplifier and the bandgap voltage node; and a sixth resistor coupled between the output of the main operational amplifier and the negative input of the compensation operational amplifier.

3. The precision bandgap reference circuit of claim 1, wherein the temperature is from about minus 40 degrees Celsius to about 120 degrees Celsius.

4. The precision bandgap reference circuit of claim 1, wherein a selected resistance value of the first adjustable resistor is stored in a nonvolatile memory.

5. A precision bandgap reference circuit, comprising:

a core bandgap circuit having a positive temperature coefficient; and proportional-to-absolute-temperature (ptat) circuit having a negative temperature coefficient coupled to the core bandgap circuit and is subtracted from the core bandgap circuit output voltage to produce a bandgap voltage;

wherein the bandgap circuit comprises:

a main operational amplifier having an output coupled to a base of a first NPN transistor, wherein the first NPN transistor has a collector coupled to a power supply positive and an emitter coupled to a bandgap voltage node;

second and third PNP transistor coupled to positive and negative inputs, respectively, of the main operational amplifier and to second and third resistors, respectively, coupled to the bandgap voltage node, and the collectors thereof coupled to a power supply common; and a first adjustable resistor coupled between the negative input of the main operational amplifier and the emitter of the third PNP transistor.

6. The precision bandgap reference circuit according to claim 5, wherein the ptat circuit comprises:

a compensation operational amplifier having an output coupled to bases of a fourth and the second PNP transistors;

a sixth diode configured PNP transistor coupled between a positive input of the compensation operational amplifier and the power supply common;

a fourth resistor coupled between a negative input of the compensation operational amplifier and an emitter of the fourth PNP transistor, wherein a collector of the fourth PNP transistor is coupled to the power supply common;

a fifth resistor coupled between the positive input of the compensation operational amplifier and the bandgap voltage node; and a sixth resistor coupled between the output of the main operational amplifier and the negative input of the compensation operational amplifier.

7. The precision bandgap reference circuit of claim 5, wherein the negative temperature coefficient ptat circuit generates a correlated output that is subtracted from the bandgap voltage to produce a sigmoidal voltage temperature curve that has minimal voltage variation over a temperature range.

8. The precision bandgap reference circuit of claim 7, wherein the temperature range is from about minus 40 degrees centigrade to about 120 degrees Celsius.

9. The precision bandgap reference circuit of claim 6, wherein the fourth resistor linearizes operation of the fourth PNP transistor.

10. The precision bandgap reference circuit of claim 5, wherein a unit ratio for the second and third PNP transistors is N:M, respectively, where M is greater than N.

11. The precision bandgap reference circuit of claim 10, where M is eight (8) and N is one (1).

12. The precision bandgap reference circuit of claim 5, wherein the third PNP transistor comprises a parallel combination of M PNP transistors and has a greater current density than the second PNP transistor.

13. The precision bandgap reference circuit of claim 5, wherein a resistance value of the first adjustable resistor is stored in a nonvolatile memory.

* * * * *